United States Patent [19]

Hasebe et al.

[11] Patent Number: 4,457,356

[45] Date of Patent: Jul. 3, 1984

[54] METHOD OF VIBRATING CONTINUOUS CASTING MOLD

[75] Inventors: Nobuhisa Hasebe; Hiroshi Kawada; both of Yokohama; Isamu Komine, Yokosuka, all of Japan

[73] Assignee: Nippon Kokan Kabushiki Kaisha, Tokyo, Japan

[21] Appl. No.: 293,210

[22] PCT Filed: Dec. 16, 1980

[86] PCT No.: PCT/JP80/00308

§ 371 Date: Aug. 13, 1981

§ 102(e) Date: Aug. 13, 1981

[87] PCT Pub. No.: WO81/01808

PCT Pub. Date: Jul. 9, 1981

[30] Foreign Application Priority Data

Dec. 21, 1979 [JP] Japan ..... 54-166364

[51] Int. Cl.[3] ..... B22D 11/04

[52] U.S. Cl. ..... 164/478; 164/416

[58] Field of Search ..... 164/416, 478, 501

[56] References Cited

U.S. PATENT DOCUMENTS 3,075,264 1/1963 Wognum ..... 164/416 X 3,153,820 10/1964 Criner ..... 164/416 X 3,672,436 6/1972 Wognum et al. ..... 164/416

FOREIGN PATENT DOCUMENTS 49-33188 9/1974 Japan .

54-86432 7/1979 Japan ..... 164/416

*Primary Examiner*—Gus T. Hampilos

*Assistant Examiner*—J. Reed Batten, Jr.

*Attorney, Agent, or Firm*—Frishauf, Holtz, Goodman and Woodward

[57] ABSTRACT

In a continuous casting mold which comprises: a plurality of ultrasonic vibrators fitted to the outer surface of each of the side walls of the mold along at least one straight line at prescribed intervals in the axial direction of the mold; the plurality of ultrasonic vibrators producing vibrating waves of identical wave lengths in the axial direction of the mold; the prescribed intervals being equal to half the wave length of the vibration waves generated in the axial direction of the mold; the improvement wherein the phases of the vibration waves of two adjacent ones of the plurality of ultrasonic vibrators are deviated by 180° from each other.

3 Claims, 2 Drawing Figures

METHOD OF VIBRATING CONTINUOUS CASTING MOLD

FIELD OF THE INVENTION

The present invention relates to a continuous casting mold which is used for a continuous casting machine.

DESCRIPTION OF THE PRIOR ART

Continuous casting of steel is generally conducted with the use of a continuous casting machine comprising a tundish, a mold, a group of guide rolls, and a group of pinch rolls. Continuous casting machines are broadly classified into the vertical type continuous casting machine and the horizontal type continuous casting machine. In the case of a vertical type continuous casting machine, molten steel received in the tundish is poured through an immersion nozzle provided in the bottom wall of the tundish into the mold. The molten steel cooled in the mold forms a solidified shell. The molten steel having thus formed the solidified shell is withdrawn, while being guided by the group of guide rolls sequentially arranged below the mold, through the group of pinch rolls. In the meantime, the solidified shell, cooled by cooling water sprayed from a plurality of nozzles arranged between said rolls, gradually increases the thickness thereof, and forms a continuously cast strand having a prescribed cross-sectional shape.

In the above-mentioned continuous casting operation, there is a problem of the molten steel seizing to the inner surface of the mold at the time of withdrawing the molten steel having formed the solidified shell from the mold. It is therefore the usual practice to vibrate the mold with a certain amplitude in the withdrawing direction of the cast strand with a view to preventing seizure of molten steel to the inner surface of the mold. This vibration of the mold has usually been effected by a mechanical means. However, in order to vibrate a mold by a mechanical means, it was necessary to provide large-scale facilities with huge quantities of energy. In addition, a mechanical means, with which is difficult to vibrate the mold at a high frequency, causes wavy vibration marks on the cast strand surface under the effect of mold vibration, which may in turn cause surface cracks of the cast strand and was therefore problematic in terms of the quality of cast strand.

Recently, the horizontal type continuous casting machine forming a cast strand by horizontally withdrawing molten steel having formed a solidified shell from a horizontal mold provided at the lower part of a side wall of the tundish has been industrially applied because of the low installation costs and other advantages. In the horizontal type continuous casting machine, the horizontal mold is directly connected to the lower part of a side wall of the tundish. It was therefore impossible to vibrate the horizontal mold alone by a mechanical means.

As a measure to solve the above-mentioned problems, a vibrating apparatus of a continuous casting mold has been disclosed in Japanese Patent Provisional Publication No. 86,432/79 dated July 10, 1979 (hereinafter referred to as the "prior art"), which comprises:

a plurality of ultrasonic vibrators, fitted to the outer surface of each of the side walls of a continuous casting mold, at prescribed intervals in the axial direction of said mold; said mold being vibrated in the axial direction thereof by the vibration of said plurality of ultrasonic vibrators.

The above-mentioned prior art appartus will be discussed with reference to the single FIG. 1 of the present application. In FIG. 1, 1 is a tundish; 2 is a molten steel discharge hole provided in the bottom wall of the tundish 1; 3 is a mold arranged below the molten steel discharge hole 2 of the tundish 1; and 8 is an immersion nozzle attached to the molten steel discharge hole 2, the lower end of the immersion nozzle 8 being located in the mold 3. The mold 3 is supported by a mold frame 6 provided on the outer peripheral surface thereof. Also 7 is a channel for cooling water provided in the interior of the mold 3. The mold 3 is cooled by cooling water flowing through the channel 7.

A plurality of ultrasonic vibrators 4 are fitted to the outer surface of each of the side walls of the mold 3 along at least one straight line at prescribed intervals in the axial direction of the mold 3. The plurality of ultrasaonic vibrators 4 produce vibration waves of identical wave lengths in the axial direction of the mold 3. In FIG. 1, 3' are a plurality of projections provided on the outer surface of each of the side walls of the mold 3 for attaching the ultrasonic vibrators 4. 5 is an electric source for generating ultrasonic vibration, to which the plurality of ultrasonic vibrators 4 are connected through respective wires 11.

In the mold 3 of the prior art having the above-mentioned construction, when the plurality of ultrasonic vibrators 4 fitted to the outer surfaces of the side walls of the mold 3 are vibrated, a horizontal vibration wave produced by this vibration is horizontally transmitted to the mold 3. The vibration wave transmitted to the mold 3 is vertically deviated by 90°, and becomes a longitudinal vibration wave 10 in the axial direction of the mold 3, i.e., along the withdrawal direction of a cast strand 9, and vibrates the mold 3 in the axial direction thereof. With a view to ensuring an efficient vibration of the mold 3, the plurality of ultrasonic vibrators 4 are fitted to the mold 3 so that the node of the vibration wave produced in the ultrasonic vibrator 4 may be located at the center of the thickness center of the side wall of the mold 3, and so that the loops of the vibration wave 10 produced in the mold 3 may be located at the both ends of the mold 3, and so that the intervals between two adjacent ultrasonic vibrators 4 may be half the wave length of the vibration wave 10. Thus, the positions of the ultrasonic vibrators 4 correspond to the locations of nodes of said vibration wave 10.

The vibration frequency of the ultrasonic vibrators 4 should preferably be about 20 kHz. With a frequency of over this level, the large damping of vibration deteriorates the vibration efficiency, whereas, with a frequency of under this level, the vibration approaches the audible range, thus causing noises. When using ultrasonic vibrators 4 with a vibration frequency of 20 kHz, the wave length of a vibration wave 10 produced in the axial direction of the mold 3 would be about 260 mm. More specifically, since the ultrasonic vibrators 4 are made of steel and the mold 3 is made of copper, a wave length of about 260 mm of said vibration wave 10 is derived, as the average, from the sound velocity of 5.81 km/sec for propagation through steel and the resultant wave length of 290 mm, and the sound velocity of 4.62 km/sec for propagation through copper and the resultant wave length of 231 mm.

Therefore, when using ultrasonic vibrators 4 with a vibration frequency of 20 kHz, the distance of half the wave length of the vibration wave 10 produced in the mold 3, i.e., the distance between two adjacent nodes of said vibration wave 10, would be equal to about 130 mm. Thus, the mold 3 can be efficiently vibrated by fitting ultrasonic vibrators 4 having a length of 130 mm at intervals of 130 mm to the outer surface of each of the side walls of the mold 3.

The above description represents a case of application of the vibrating apparatus of the prior art to a vertical type continuous casting machine. It is also possible to apply this prior art vibrating apparatus to a horizontal type continuous casting mold. In the case of application to a horizontal type continuous casting mold, ultrasonic vibrators are vertically fitted to the outer surface of each of the side walls of the horizontal mold. The vibration wave transmitted vertically to the horizontal mold is horizontally deviated by an angle of 90°, and can thus vibrate the horizontal mold in the axial direction thereof, i.e., in the horizontal withdrawing direction of a cast strand from the mold.

According to the vibrating apparatus of the above-mentioned prior art, it is possible to vibrate the mold in the axial direction thereof, i.e., in the withdrawing direction of cast strand at a high frequency, thus permitting prevention of seizure of a cast strand to the inner surface of the mold. Unlike a vibrating apparatus based on a mechanical means, this does not require huge quantities of energy nor large-scale facilities, and does not cause wavy vibration marks on the surface of cast strand under the effect of vibration of the mold. In the application thereof to a mold for a horizontal type continuous casting machine, furthermore, the fine vibration at a high frequency imparted to the mold keeps a high degree of seal at the junction between the tundish and the mold, without leakage of molten steel from this junction caused by vibration of the mold.

However, in the above-mentioned prior art, when a plurality of ultrasonic vibrators 4 fitted at prescribed intervals to the outer surface of each of the side walls of the mold 3 have identical phases, the mold 3 cannot be vibrated efficiently in the axial direction thereof. More particularly, in FIG. 1, when ultrasonic vibrators 4*a*, 4*b*, 4*c* and 4*d* fitted to the outer surface of each of the side walls of the mold 3 at intervals equal to half the wave length of the vibration wave 10 produced in the axial direction of said mold 3 have identical phases of vibration waves, the vibration waves produced in the axial direction of the mold 3 by the ultrasonic vibrators 4*a* and 4*b*, for example, would have wave forms deviated by 180° from each other, and the ultrasonic vibrators 4*b* and 4*c*, and 4*c* and 4*d* would also have wave forms deviated by 180° from each other. As a result, vibration waves produced in the axial direction of the mold 3 cancel each other, thus resulting in an extremely low efficiency in vibration of the mold 3 in the axial direction thereof.

SUMMARY OF THE INVENTION

An object of the present invention is therefore to provide a continuous casting mold for vibrating the mold at a high efficiency in a continuous casting machine.

In accordance with one of the features of the present invention, in a continuous casting mold which comprises:

a plurality of ultrasonic vibrators fitted to the outer surface of each of the side walls of said mold along at least one straight line at prescribed intervals in the axial direction of said mold; said plurality of ultrasonic vibrators producing vibration waves of identical wave lengths in the axial direction of said mold; said prescribed intervals being equal to half the wave length of said vibration waves generated in the axial direction of said mold;

the improvement is characterized in that:

the phases of said vibration waves of two adjacent ones of said plurality of ultrasonic vibrators are deviated by 180° from each other.

DETAILED DESCRIPTION OF THE INVENTION

With a view to improving the vibration efficiency in the case where a continuous casting mold is vibrated with the use of ultrasonic vibrators, we carried out intensive studies. As a result, we developed a continuous casting mold of the aforementioned type wherein the phases of the vibration waves of two adjacent ones of a plurality of ultrasonic vibrators are deviated by 180° from each other.

Now, the continuous casting mold of the present invention (hereinafter referred to as the "mold of the present invention")is described below by means of an example with reference to FIG. 2.

Figure 1:
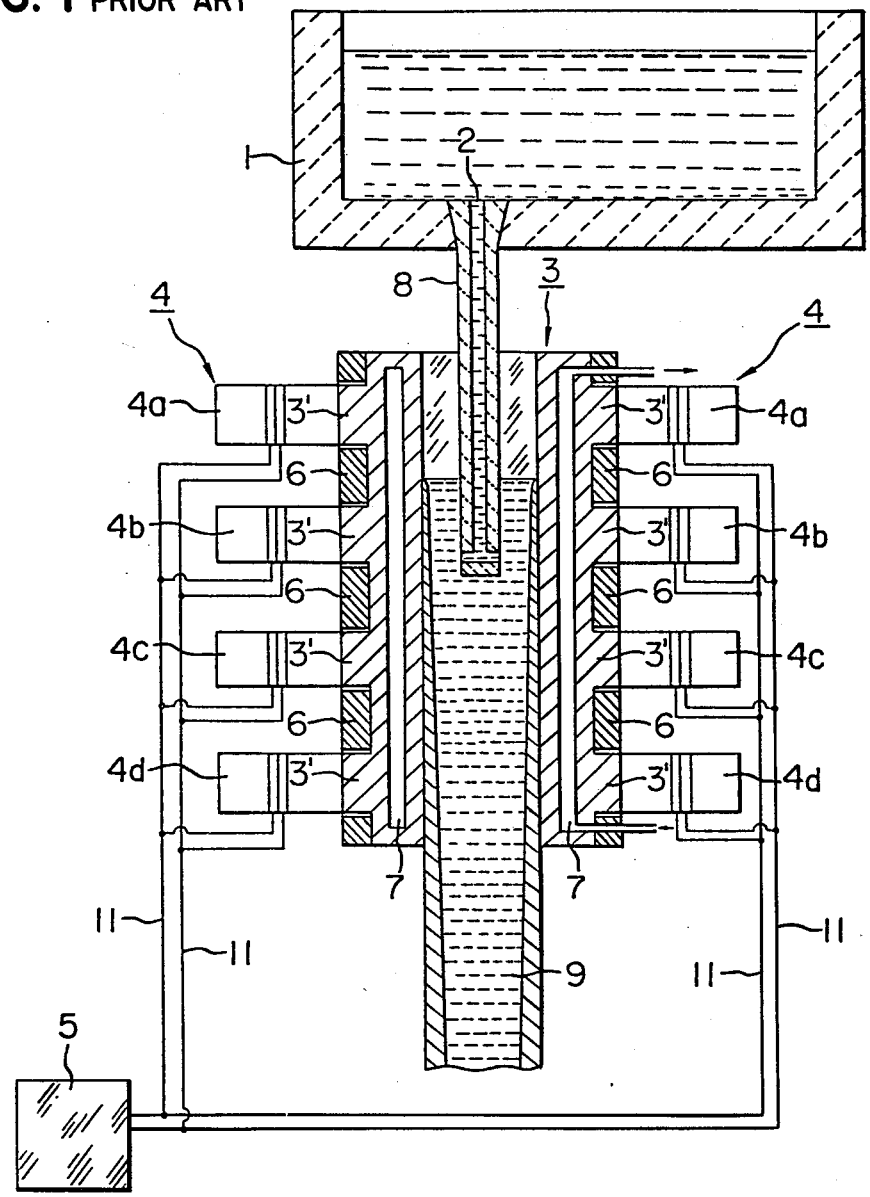
FIG. 1 PRIOR ART
FIG. 1 is a longitudinal sectional view showing the mold portion of a prior art vertical type continuous casting machine.
Figure 2:
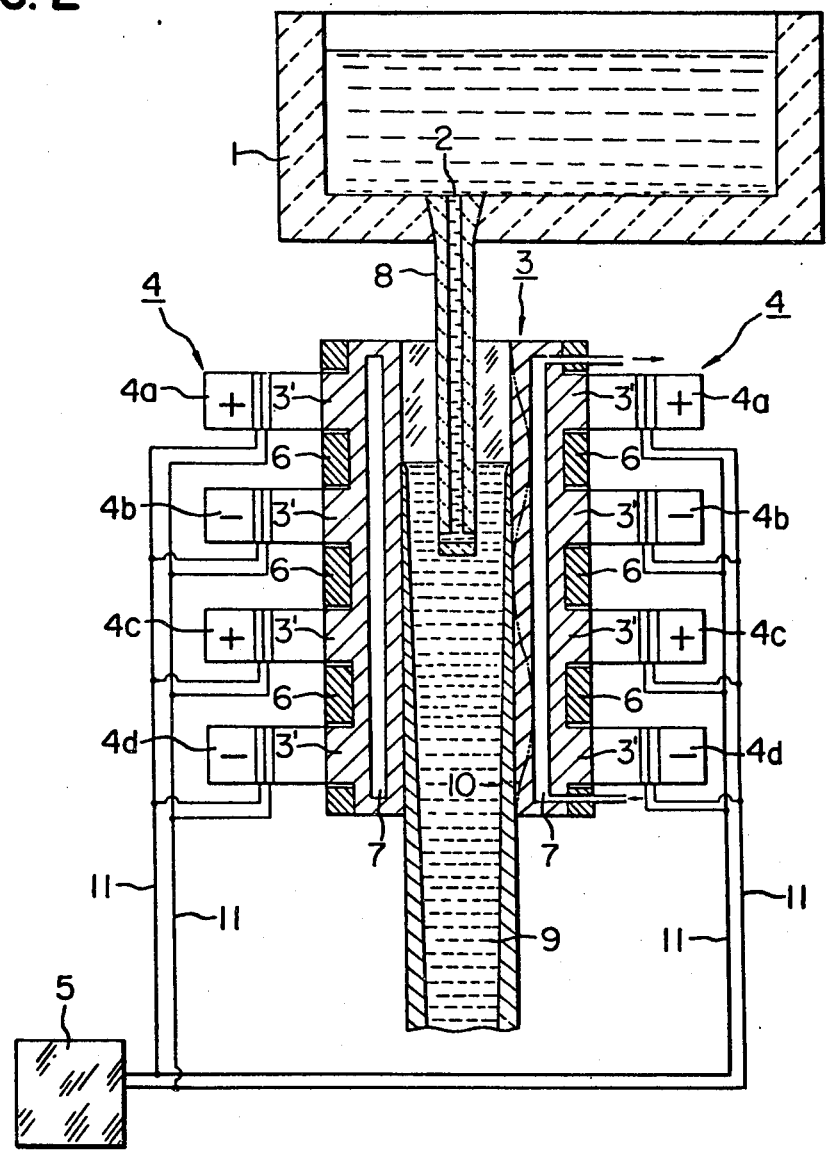
FIG. 2 is a longitudinal sectional view showing the mold portion of a vertical type continuous casting machine in accordance with the present invention.

The mold of the present invention is identical with that in the above-mentioned prior art in that the mold is provided, as shown in the FIG. 2, with a plurality of ultrasonic vibrators 4 fitted at prescribed intervals along at least one straight line in the axial direction of the mold 3 to the outer surface of each of the side walls of the mold 3, said plurality of ultrasonic vibrators producing vibration waves of identical wave lengths in the axial direction of the mold 3, and said prescribed intervals being equal to half the wave length of the vibration wave 10 produced in the axial direction of the mold 3.

In the mold of the present invention, the vibration waves of the plurality of ultrasonic vibrators 4 have phases deviated by 180° from each other between two adjacent vibrators. More specifically, in FIG. 2, the phases of the vibration waves of the ultrasonic vibrators 4*a* and 4*b* are deviated by 180° from each other by using a positive vibrator as the ultrasonic vibrator 4*a* and a negative vibrator as the next ultrasonic vibrator 4*b*. Similarly, by using a positive vibrator as the ultrasonic vibrator 4*c* and a negative vibrator as the next ultrasonic vibrator 4*d*, the phase of the vibration wave is deviated by 180° between the ultrasonic vibrators 4*b* and 4*c* and between 4*c* and 4*d*.

As a result, longitudinal vibration waves produced in the axial direction of the mold 3 by the ultrasonic vibrators 4*a*, 4*b*, 4*c* and 4*d* have identical wave forms. In the axial direction of the mold 3, therefore, an amplified vibration wave 10 is produced by the ultrasonic vibrators 4*a*, 4*b*, 4*c* and 4*d*, and thus, the mold 3 is efficiently vibrated in the axial direction thereof.

In the above-mentioned example, the plurality of ultrasonic vibrators 4 are fitted at prescribed intervals along a straight line in the axial direction of the mold 3 to the outer surface of each of the side walls of the mold 3. However, the vibration efficiency of the mold 3 in the axial direction thereof can be further improved by fitting the plurality of ultrasonic vibrators 4 at prescribed intervals along a plurality of straight lines in the axial direction of the mold 3, said plurality of straight lines being arranged at prescribed intervals. In addition, the mold of the present invention is applicable to a mold for a vertical type continuous casting machine as well as to a mold for a horizontal type continuous casting machine, and in all cases, it is possible to vibrate the mold at a high efficiency in the axial direction thereof.

According to the mold of the present invention, as described above in detail, it is possible to vibrate the mold in the axial direction thereof at a high efficiency with the use of a plurality of ultrasonic vibrators which are fitted to the outer surface of each of the side walls of the mold in the axial direction thereof along at least one straight line at prescribed intervals, thereby permitting prevention of seizure of a cast strand to the inner surface of the mold. In the case where the mold of the present invention is applied to a horizontal type continuous casting machine, only the horizontal mold can be vibrated in the axial direction thereof at a high efficiency in a state in which a perfect seal is maintained at the junction between the tundish and the mold. According to the mold of the present invention, therefore, many industrially useful effects are provided.

What is claimed is:

1. In a method of operating a continuous casting mold which comprises:

means defining a mold having side walls, said side walls having outer surfaces;

a plurality of ultrasonic vibrators fitted to the outer surface of each of said side walls of said mold along at least one straight line at prescribed intervals in the axial direction of said mold; and a source of electrical power coupled to said plurality of ultrasonic vibrators for causing them to vibrate and produce vibration waves of identical wave lengths in the axial direction of said mold;

said prescribed intervals being equal to half the wave length of said vibration waves produced in the axial direction of said mold;

the improvement comprising:

causing the phases of said vibration waves of two adjacent ones of said plurality of ultrasonic vibrators of each of said side walls to be deviated by 180° from each other, said two adjacent ones being in the axial direction of said mold.

2. The method of operating a continuous casting mold of claim 1, wherein said step of causing said deviation of phases includes providing a pair of adjacent ultrasonic vibrators, one of which is a positive vibrator, and the other of which is a negative vibrator.

3. The method of operating a continuous casting mold of claim 2, wherein each pair of adjacent ones of said plurality of ultrasonic vibrators comprises a positive vibrator and a negative vibrator, respectively.

* * * * *